US011195673B2

(12) United States Patent
Gati et al.

(10) Patent No.: US 11,195,673 B2
(45) Date of Patent: Dec. 7, 2021

(54) ARC CHAMBER FOR A DC CIRCUIT BREAKER

(71) Applicant: ABB Schweiz AG, Baden (CH)

(72) Inventors: Rudolf Gati, Mellingen (CH); Matthias Bator, Klettgau (DE); Osvaldo Prestini, Nembro (IT); Pierluigi Cisana, Paladina BG (IT); Thorsten Strassel, Mülligen (CH)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 16/600,680

(22) Filed: Oct. 14, 2019

(65) Prior Publication Data

US 2020/0043676 A1 Feb. 6, 2020

Related U.S. Application Data

(63) Continuation of application No. PCT/EP2018/059534, filed on Apr. 13, 2018.

(30) Foreign Application Priority Data

Apr. 13, 2017 (EP) ..... 17166488

(51) Int. Cl.
*H01H 9/34* (2006.01)
*H01H 9/36* (2006.01)

(52) U.S. Cl.
CPC ..... *H01H 9/346* (2013.01); *H01H 9/341* (2013.01); *H01H 9/36* (2013.01); *H01H 2009/367* (2013.01)

(58) Field of Classification Search
CPC ..... H01H 9/346; H01H 9/341; H01H 9/36; H01H 9/32; H01H 9/345; H01H 9/362;
(Continued)

(56) References Cited

U.S. PATENT DOCUMENTS 5,589,672 A * 12/1996 Uchida ..... H01H 9/342 218/34
6,248,970 B1 * 6/2001 DiMarco ..... H01H 9/34 218/149
(Continued)

FOREIGN PATENT DOCUMENTS

CN 1835151 A 9/2006
CN 101036210 A 9/2007
(Continued)

OTHER PUBLICATIONS

European Patent Office, International Search Report & Written Opinion issued in corresponding Application No. PCT/EP2018/059534, dated Jun. 8, 2018, 10 pp.
(Continued)

*Primary Examiner* — William A Bolton
(74) *Attorney, Agent, or Firm* — Greenberg Traurig, LLP

(57) ABSTRACT

An arc chamber for a DC circuit breaker includes an entry side adapted to receive an electric arc, which was generated outside of the arc chamber and which propagates in a forward direction, a plurality of stacked splitter plates, and at least one inhibitor barrier. The at least one inhibitor barrier is arranged on the entry side to inhibit a reverse propagation of the electric arc out of the arc chamber in a reverse direction. DC circuit breaker comprising an arc chamber. Use of an arc chamber with a circuit breaker in a DC electrical system.

13 Claims, 2 Drawing Sheets

(58) Field of Classification Search
CPC .. H01H 2009/348; H01H 33/08; H01H 33/10; H01H 33/182; H01H 9/342; H01H 2009/367; H01H 9/34
USPC .. 218/149, 15, 34, 37, 38, 41, 46, 147, 151, 218/156, 76, 81, 105, 150
See application file for complete search history.

(56) References Cited

U.S. PATENT DOCUMENTS

| | | | | |
|---|---|---|---|---|
| 7,034,242 | B1 * | 4/2006 | Shea | H01H 9/362 218/149 |
| 7,186,941 | B2 * | 3/2007 | Yeon | H01H 9/302 218/149 |
| 7,285,742 | B2 * | 10/2007 | Kinzler | H01H 71/0207 218/34 |
| 7,466,528 | B2 | 12/2008 | Lafon | |
| 8,519,292 | B2 | 8/2013 | Domejean | |
| 9,396,890 | B2 * | 7/2016 | Smeltzer | H01H 9/34 |
| 2002/0134758 | A1 * | 9/2002 | Duggal | H01H 9/36 218/154 |
| 2005/0263492 | A1 * | 12/2005 | McCoy | H01H 9/362 218/34 |
| 2006/0086693 | A1 | 4/2006 | Yeon | |
| 2013/0284702 | A1 * | 10/2013 | Hamada | H01H 9/302 218/26 |
| 2014/0339196 | A1 * | 11/2014 | Seo | H01H 9/362 218/149 |
| 2015/0348720 | A1 * | 12/2015 | Smeltzer | H01H 9/36 218/151 |

FOREIGN PATENT DOCUMENTS

| | | | |
|---|---|---|---|
| CN | 107305815 | A | 10/2017 |
| EP | 0217106 | A2 | 4/1987 |
| EP | 1655752 | A2 | 5/2006 |
| EP | 2061051 | A1 | 5/2009 |
| EP | 2717288 | A1 | 4/2014 |
| FR | 2262858 | A1 | 9/1975 |
| FR | 2873511 | A1 | 1/2006 |

OTHER PUBLICATIONS

European Patent Office, Extended Search Report issued in corresponding Application No. 17166488.1, dated Sep. 28, 2017, 6 pp.
The Patent Office of the People's Republic of China, First Office Action issued in corresponding Chinese application No. 201880024572.X, dated Jan. 29, 2021, 12 pp.
Second Office Action, issued by the Chinese Patent Office, regarding corresponding patent application Serial No. CN201880024572.X; dated Aug. 27, 2021; 8 pages (with English Translation).

* cited by examiner

ARC CHAMBER FOR A DC CIRCUIT BREAKER

TECHNICAL FIELD

Aspects of the present disclosure relate generally to an arc chamber for a DC circuit breaker, to a DC circuit breaker comprising an arc chamber as disclosed herein, and a use of an arc chamber with a circuit breaker in a DC electrical system.

BACKGROUND ART

In certain types of circuit breakers, contacts are separated from each other by a mechanical movement, such that an arc is ignited between the contacts. The arc is guided, typically along metallic rails, towards a stacked arrangement of a plurality of splitter plates, which are located inside an arcing chamber filled with a switching medium. The splitter plates are typically arranged substantially in parallel to each other, side by side in a stacking direction, wherein a space is thrilled in between each pair of adjacent splitter plates.

The arc impacts upon the edges of the splitter plates and is split in several arc segments. Ideally, the arc enters the splitter plates, and the arc segments stay within the splitter plate region until the current is interrupted. Then, the arc is extinguished.

Because of electromagnetic interaction among the arc segments, the arc can propagate in a backwards direction, i. e. towards the side where it entered the stack of splitter plates. In this case, the arc is hindered from being extinguished within a reasonable amount of time, which may result in undesired prolongation of the arc extinguishing process.

SUMMARY OF THE DISCLOSURE

An object of the disclosure is to provide an arc chamber with an improved arc extinguishing capability, particularly allowing to extinguish an arc more reliably even under difficult conditions, while maintaining a low-cost and/or compact design.

In view of the above, an arc chamber for a DC circuit breaker according to claim 1, a DC circuit breaker comprising an arc chamber according to claim 11, and a use of an are chamber with a circuit breaker in a DC electrical system according to claim 12 are provided. According to a first aspect, an arc chamber for a DC circuit breaker is provided. The arc chamber comprises an entry side, a plurality of stacked splitter plates and at least one inhibitor barrier. The entry side is adapted to receive an electric arc which was generated outside of the arc chamber and which propagates in a forward direction. The at least one inhibitor plate is arranged on the entry side and is configured and arranged such as to inhibit a reverse propagation of the electric arc out of the arc chamber in a reverse direction.

According to another aspect of the disclosure, a DC circuit breaker is provided. The DC circuit breaker comprises an arc chamber as described herein. According to yet a further aspect of the disclosure, a use of an arc chamber, as described herein, with a circuit breaker in a DC electrical system is provided.

When the arc enters the chamber on the entry side, it propagates in the forward direction towards the stack, or pile, of splitter plates. Back propagation of the arc which once entered the chamber, i. e. a propagation in the reverse direction, such that the arc eventually leaves the chamber again on the entry side, is suppressed by the arrangement and configuration of the at least one inhibitor plate.

In embodiments, in a top view of the arc chamber, i.e. in a viewing direction along the stacking direction of the splitter plates, the at least one inhibitor barrier is arranged in a corner part on the entry side of the arc chamber. Additionally, the arc chamber may comprise at least two inhibitor barriers, each of which is arranged, in the top view of the chamber, in opposite corner parts on the entry side of the arc chamber. Optionally, when at least two inhibitor barriers are provided in opposite corner parts on the entry side of the arc chamber, the at least two inhibitor barriers may be spaced apart from each other, thus forming a gap for the entry of the electric arc into the region of the stacked splitter plates.

An arc which propagates in the reverse direction often moves, from a central region of the arc chamber, to the corner parts of the chamber. An inhibitor barrier, which is arranged in the corner part on the entry side, optionally one inhibitor plate per different corner part, may help to further improve to prevent the back propagation of the arc more effectively or more selectively. A gap for the entry of the electric arc may help to ensure that the arc may enter the splitter plate region substantially unhindered, while it is effectively prevented to propagate in the reverse direction beyond the corners on the entry side. In embodiments, the at least one inhibitor barrier extends substantially in the stacking direction of the splitter plates. The at least ore inhibitor barrier extending substantially in the stacking direction of the splitter plates may continuously extend essentially from one outermost splitter plate of the stack to the other outermost splitter plate of the stack.

Alternatively, the at least one inhibitor barrier extending substantially in the stacking direction of the splitter plates may be formed of a pile of inhibitor plates which are arranged in an aligned manner in the stacking direction, wherein each inhibitor plate is provided between adjacent ones of the plurality of splitter plates, i.e. between at least one pair of adjacent splitter plates of the plurality of splitter plates. Optionally, a respective inhibitor plate is provided between each of the adjacent ones of the plurality of splitter plates, i.e. between each pair of adjacent splitter plates of the plurality of splitter plates.

In embodiments, the arc chamber comprises an inlet of an exhaust channel in a region of the at least one inhibitor barrier. The region of the at least one inhibitor barrier, where the inlet is provided, is an area, where it is likely that at least a major part of a flow of hot gas, which is generated by the propagating arc, streams into the inlet. The exhaust channel extends to a gas outlet. The gas outlet is formed on a side of the arc chamber, which is different from the entry side. In this way, the hot gas may be effectively guided to a location, where it does not delay or prevent the arc from being extinguished.

Further advantages, features, aspects and details that can be combined as appropriate with embodiments described herein are disclosed in the dependent claims and claim combinations, in the description and in the drawings.

BRIEF DESCRIPTION OF THE DRAWINGS

The disclosure will be described in greater detail with reference to the accompanying drawings, in which.

EMBODIMENTS OF THE DISCLOSURE

Figure 1A:
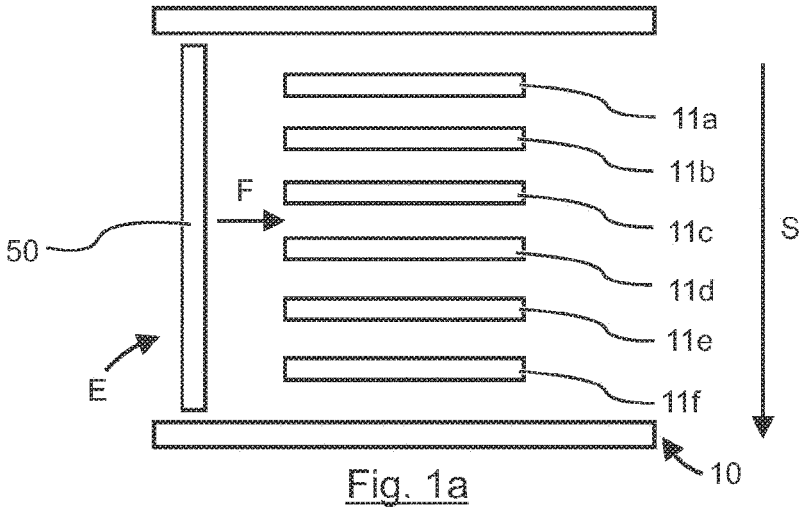
FIGS. 1*a*-1*c* show a schematic cross-sectional side view of an arc chamber with a schematic representation of different stages of an arc propagating towards a plurality of stacked splitter plates, according to a comparative example.

Reference will now be made in detail to various aspects and embodiments. Each aspect and embodiment is provided by way of explanation and is not intended as a limitation. Features illustrated or described as a part of one aspect or embodiment may be used in conjunction with any other aspect or embodiment. It is intended that the present disclosure includes such combinations and modifications. In the drawings, same reference numerals refer to same or like parts. For casing the understanding, some reference numerals are omitted in those drawings showing essentially the same structure, at a different point in time, of a preceding drawing.

Figure 1B:
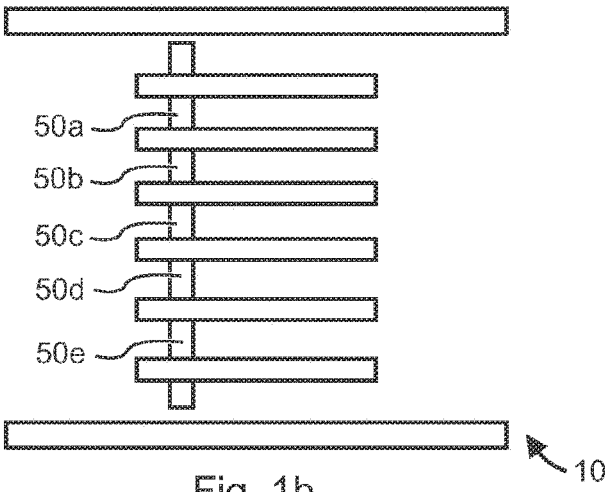
Figure 1C:
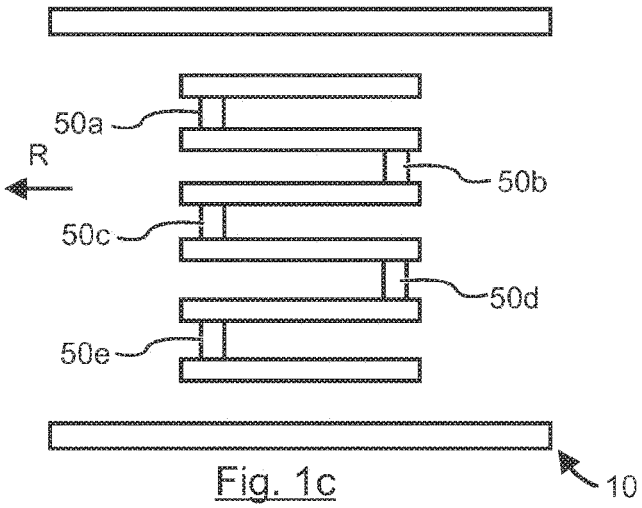

FIGS. 1*a*-1*c* show a schematic cross-sectional side view of an arc chamber 10 according to a comparative example for explanatory purposes. In FIGS. 1*a*-1*c*, a stack or pile comprises a plurality of splitter plates 11*a* to 11*f* which are arranged substantially parallel to each other and at a distance between each pair of adjacent splitter plates 11*a*-11*b*, 11*b*-11*c*, 11*c*-11*d*, 11*d*-11*e*, 11*e*-11*f*, in a stacking direction S. Typically, the stacking direction S corresponds to an up-down direction of the chamber 10. The number of splitter plates depicted in the drawings is only intended as an example and not to be interpreted as a limitation.

An arc 50 is generated outside of the arc chamber 10, e. g. in between the opening contact elements of a low-voltage or medium-voltage circuit breaker (not shown). The arc is ignited in a space filled with a switching medium. While the arc burns in between the contacts, the arc voltage does not change much. At some point in time, the are detaches from the contacts, bends, and moves, typically along metallic rails known as arc runners, towards the stack of splitter plates 11*a*-11*f*.

In FIG. 1*a*, the arc 50 is still outside the stack and propagates in a forward direction F, until it reaches, i. e. impacts on, the front edges of the splitter plates 11*a*-11*f*. The front edges are located on a side of the arc chamber 10 where the arc 50 impacts thereon, and this side of the arc chamber will be referred to as an entry side E herein. The voltage due to the burning arc increases and the arc commutes further into the region of the splitter plates 11*a*-11*f*.

In FIG. 1*b*, after the impact, the arc 50 is split into several segments 50*a*-50*e* inside the spaces in between adjacent ones of the splitter plates 11*a*-11*f*. A maximum arc voltage is maintained, until the current is interrupted. A cooling effect of the splitter plates 11*a*-11*f* may help to extinguish the arc segments 50*a*-50*e* and to interrupt the current. The time taken to interrupt the current may be increased, in the comparative example of FIGS. 1*a*-1*c*, due to a phenomenon referred to as "back-ignitions" in the following. Preceding a back-ignition, the non-extinguished arc 50 or arc segments 50*a*-50*e* propagate in a reverse direction R. An additional delay due to the back-ignition leads to a large amount of energy deposited in the circuit breaker, and hence to an increased wear of the circuit breaker.

In FIG. 1*c*, a magnetic interaction between the arc segments 50*a*-50*e* generates repelling forces, which act on some or all of the arc segments 50*a*-50*e*. An asymmetry in the position of the arc segments 50*a*-50*e* along the stacking direction S will be enhanced by the repelling forces, leading to a repulsion of the arc segments 50*a*-50*e* with respect to their neighbours in the stacking direction S. One or more of the arc segments 50*a*, 50*c*, 50*e* in FIG. 1*c* are likely to propagate further in the reverse direction R and lead to a back-ignition.

Figure 2A:
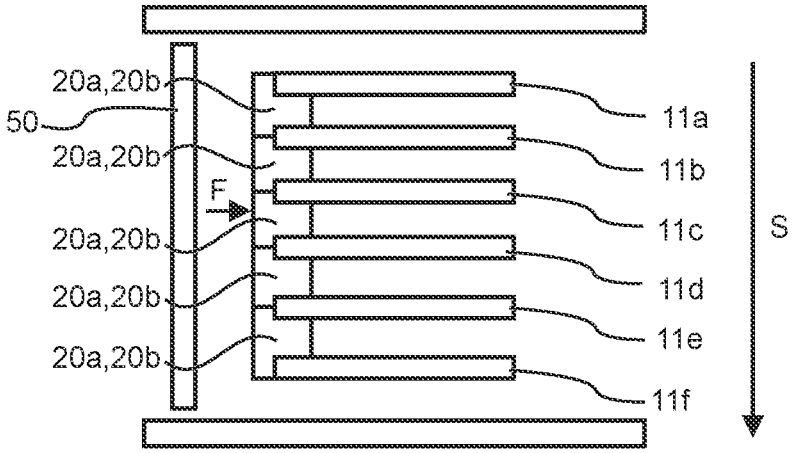
FIG. 2*a* shows a schematic cross-sectional side view of an arc chamber comprising inhibitor barriers, according to an embodiment of the invention.

FIG. 2*a* shows a sectional side view of an arc chamber 10 according to an embodiment. In FIG. 2*a*, inhibitor barriers 20*a*, 20*b* are provided and arranged on the entry side E of the chamber 10. The spatial arrangement of the inhibitor barriers 20*a*, 20*b* relative to the plane of projection, according to the embodiment, becomes more apparent from the sectional top view of FIG. 2*b* which corresponds to the view of FIG. 2*a*.

Figure 2B:
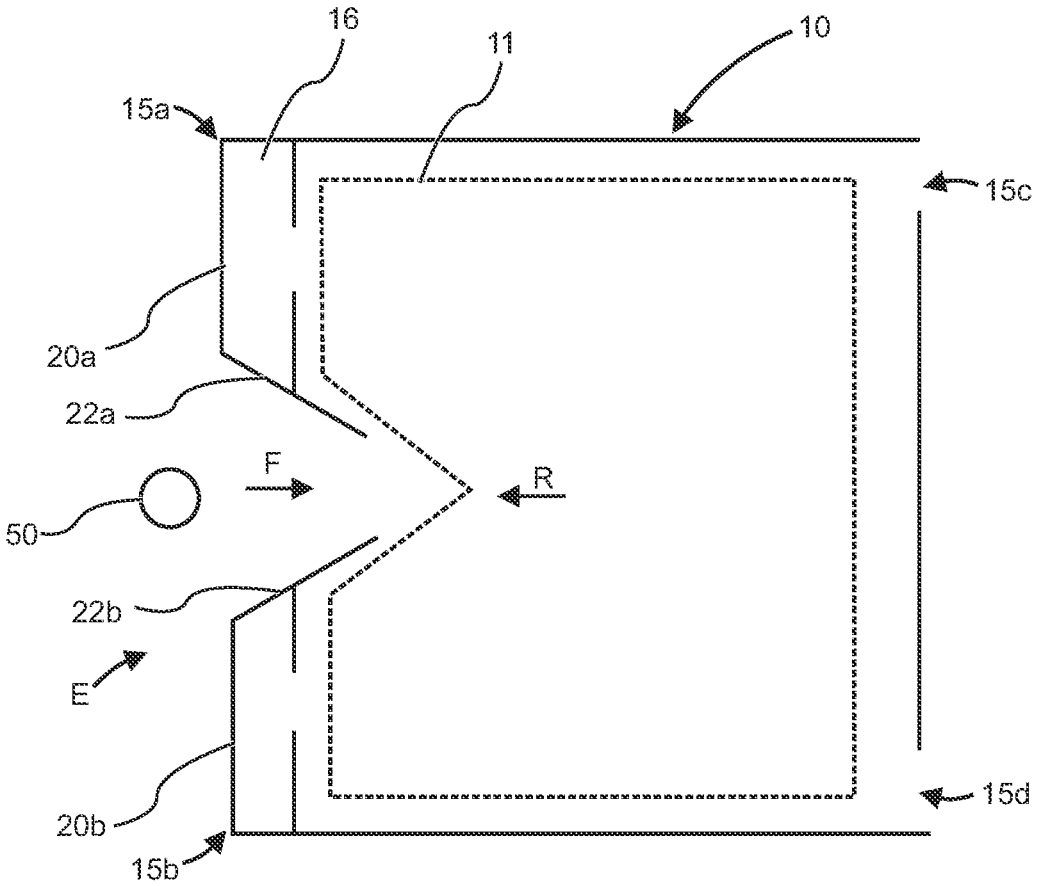
FIG. 2*b* shows a schematic cross-sectional top view of the arc chamber of FIG. 2*a*.

In FIG. 2*b*, an arbitrary splitter plate 11 out of the plurality of splitter plates 11*a*-11*f* is shown with a dashed line. The inhibitor barriers 20*a*, 20*b* are arranged on the entry side E in such a manner that they inhibit a reverse propagation of the electric arc out of the arc chamber in the reverse direction R. In other words, the inhibitor barriers 20*a*, 20*b* are arranged such that they substantially prohibit a flow of hot gas from flowing, in the reverse direction R, beyond the entry region of the chamber 10.

It is to be noted that a reverse direction R is not necessarily an exact opposite direction of the forward direction F, but may be an oblique direction towards the entry side E, e. g. towards any one of the corner parts 15*a*, 15*b* on the entry side E of the chamber 10.

In the top view of FIG. 2*b*, the inhibitor barriers 20*a*, 20*b* are arranged such that a gap (i.e. a gap when seen in top view or when viewing along the stacking direction of the splitter plates) for the entry of the arc 50 is formed (i.e. formed between the inhibitor barriers 20*a*, 20*b*), when the arc 50 propagates in the forward direction F. After the entry of the arc 50 and split-up into the arc segments 50*a*-50*e* (present in FIG. 2*a*, as shown in FIG. 1), the arc propagates further into a central part of the chamber 10. Subsequently, there is a high likelihood for all or some of the arc segments 50*a*-50*e* to propagate into the direction of front corner parts 15*a* or 15*b* on the entry side E of the chamber 10, of rear corner parts 15*c* or 15*d* on the opposite side of the chamber 10.

Hot gas which is generated by arc segments 50*a*-50*e*, which propagate towards any of the front corner parts 15*a*, 15*b*, may result in hot conductive gas which leads to a back-ignition (a re-ignition), even after the respective arc segments 50*a*-50*e* have been extinguished.

In the embodiment of FIGS. 2*a* and 2*b*, the inhibitor barrier 20 *a*, 20*b* or inhibitor barriers 20*a*, 20*b* is or are arranged in a corner part 15*a*, 15*b* or in both corner parts 15*a*, 15*b* on the entry side E of the arc chamber 10. Any inhibitor barrier 20*a*, 20*b* serves as a protective structure around the arcing locations in the region of the front edges of the splitter plates 11*a*-11*f*, i. e. on the entry side E. The hot gas is guided away, by means of the inhibitor barrier 20*a*, 20*b* such arranged, to reduce or eliminate the probability of back-ignitions. When at least two inhibitor barriers 20*a*, 20*b* are provided, each one in a respective corner part 15*a*, 15*b*, the front corner parts 15*a*, 15*b* are shielded by the inhibitor barriers 20*a*, 20*b*, while a gap is left in between the inhibitor barriers 20*a*, 20*b* when seen in the top view.

The arc 50 or arc segments 50*a*-50*e* may first enter the splitter plate region in a substantially unobstructed manner, while a back-propagation of the arc, possibly leading to back ignitions, is effectively suppressed or prevented by the inhibitor barrier 20*a*, 20*b*. Optionally, the inhibitor barrier 20*a*, 20*b* is configured and/or arranged such that a flow of gas cannot pass in the reverse direction R beyond the entry area of the arc chamber 10 in a region where the inhibitor barriers 20*a*, 20*b* are provided. It is to be noted that the number of inhibitor barriers 20*a*, 20*b* is not limited to two.

In embodiments, the inhibitor barrier 20*a*, 20*b* extends from one outermost splitter plate 11*a* of the stack of splitter plates 11*a*-11*f* to the other outermost splitter plate 11*f*. In other words: According to this aspect, all of the spaces in between the splitter plates 11*a*-11*f* are shielded, on the entry side and in a limited region such as a respective corner region 15*a*, 15*b* when seen in the top view, by the respective inhibitor barrier 20*a*, 20*b*. The outermost splitter plates 11*a*, 11*f* are the splitter plates on the one end side and on the other end side, respectively, of the stack of splitter plates 11*a*-11*f* in the stacking direction.

According to this aspect, the inhibitor barrier 20*a*, 20*b* may be formed continuously, optionally as a continuous wall which covers the respective area at the stacked splitter plates 11*a*-11*f* as a whole. Alternatively, and still pertaining to this aspect, the inhibitor barrier 20*a*, 20*b* may be formed of a plurality of barrier segments covering less than the entirety of the respective area at the stacked splitter plates 11*a*-11*f*, while the plurality of barrier segments which form the inhibitor barriers 20*a*, 20*b* still shield all of the spaces in between the splitter plates 11*a*, 11*f* on the entry side in the respective region.

A back-propagation of the arc, possibly leading to a back-ignition, can be suppressed or prevented substantially over the entire stack of splitter plates 11*a*-11*f*, i. e. for each of the arc segments 50*a*-50*e* that move or propagate in the respective spaces.

As shown in FIG. 2*a*, the inhibitor barrier 20*a*, 20*b* is formed of a pile of inhibitor plates which are arranged in an aligned manner in the stacking direction, and each provided inhibitor plate is arranged between adjacent ones of the plurality of splitter plates 11*a*-11*f*. An inhibitor plate arranged between at least one pair of adjacent splitter plates 11*a*-11*f* abuts on both splitter plates 11*a*-11*b*, 11*b*-11*c*, etc. to effectively prevent hot gases from moving and/or penetrating in the reverse direction R beyond the front edges of the splitter plates 11*a*-11*f* the entry side E. Optionally, a respective inhibitor plate is arranged between each pair of the adjacent ones of the plurality of splitter plates 11*a*-11*f*, i.e. in each of the spaces between the splitter plates 11*a*-11*f*.

According to this aspect, the inhibitor barrier 20*a*, 20*b* is not continuous; yet, some or all of the spaces between the splitter plates 11*a*-11*f*, on the entry side and in a limited region such as a respective corner region 15*a*, 15*b* when seen in the top view, are shielded by an inhibitor plate.

The splitter plates 11*a*-11*f* which are substantially aligned in the stacking direction S form a respective inhibitor barrier 20*a*, 20*b*, which suppresses or prevents a back-propagation of an arc 50 or arc segment 50*a*-50*e* by prohibiting the hot gas generated by the arc 50 or arc segment 50*a*-5*e* from flowing back in the reverse direction, in the region, where the splitter plates 11*a*-11*f* are provided, e. g. in a corner region 15*a*, 15*b* on the entry side E.

As shown in FIG. 2*b*, the inhibitor barriers 20*a*, 20*b* may comprise a respective deflection section 22*a*, 22*b* which extends (i.e. when seen in the top view of the arc chamber 10) to the inside of the arc chamber 10. The deflection section or sections 22*a*, 22*b* may help to trap and deflect an arc 50 or an arc segment 50*a*-50*e* such that it does not move or propagate to the region of the gap, that is formed on the entry side in between the inhibitor barriers 20*a*, 20*b* for providing the entry of the electric arc 50 into the arc chamber 10. In the embodiment of FIGS. 2*a*-2*b*, in the rear corner parts 15*c*, 15*d* opposite to the entry side E of the chamber 10, exhaust openings are provided for releasing a flow of hot gas. A release of hot gas on the side opposite to the entry side is uncritical in view of a back-ignition or re-ignition of an arc. In embodiments, the arc chamber 10 may further comprise at least one exhaust channel 16. The exhaust channel 16 has an inlet in a region of the at least one inhibitor barrier 20*a*, 20*b*. The exhaust channel 16 extends, from the inlet, to a gas outlet. The gas outlet is formed on a side of the arc chamber 10 which is different from the entry side.

For example, the outermost splitter plate 11*a* in FIG. 2*a* is arranged on a top side of the chamber 10, the outermost splitter plate 11*f* in FIG. 2*a* is arranged on a bottom side of the chamber 10, the side having the rear corner parts 15*c*, 15*d* in FIG. 2*b* is the rear side of the chamber 10, and the remaining two sides other than the entry side E are a first lateral side and a second lateral side, respectively, of the chamber 10. The gas outlet may, for example, be provided in any one of the top side, the bottom side, the rear side, the first lateral side, and the second lateral side.

At least a part of the hot gas which is generated in the region, where the inlet of the exhaust channel 16 is provided, flows into the inlet, passes through the exhaust channel 16, and is eventually discharged from the chamber 10, on a side of the chamber 10 which is different from the entry slide. Thus, less hot gas will back-propagate in the direction of the entry side, and a probability of a back-ignition can be further reduced.

In embodiments, a DC circuit breaker (not shown) having an arcing contact arrangement is provided with an arc chamber 10 as described herein. In the DC circuit breaker, upon a contact opening operation, an electric arc is generated, which is received on the entry side E of the arc chamber 10 and propagates in a forward direction into the region of the stacked splitter plates. The at least one inhibitor barrier arranged on the entry side E is configured such as to inhibit a reverse propagation of the arc out of the arc chamber 10 in the reverse direction R. It is noted that also in the DC circuit breaker provided with the arc chamber 10, some or all of the aspects as described herein may be implemented and/or freely combined with each other, as appropriate.

In embodiments, an arc chamber 10, as described herein, is used with a circuit breaker in a DC electrical system. It is noted that also in the use of the arc chamber 10 with a circuit breaker in a DC electrical system, some or all of the aspects as described herein may be implemented and/or freely combined with each other, as appropriate,

The invention claimed is:

1. An arc chamber for a DC circuit breaker, comprising:

an entry side adapted to receive an electric arc which was generated outside of the arc chamber and which propagates in a forward direction;

a plurality of stacked splitter plates with spaces therebetween;

at least one inhibitor barrier arranged on the entry side and blocking a portion of at least one of the spaces to inhibit a reverse propagation of the electric arc out of the arc chamber in a reverse direction; wherein the at least one inhibitor barrier does not block another portion of the at least one of the spaces on the entry side to allow the electric arc to enter the at least one of the spaces;

the at least one inhibitor barrier extends in a stacking direction of the splitter plates; and the at least one inhibitor barrier is formed of a pile of inhibitor plates, which are arranged in an aligned manner in the stacking direction, wherein each inhibitor plate is provided between adjacent splitter plates of the plurality of splitter plates, and wherein the pile of inhibitor plates extends continuously in the stacking direction of the splitter plates from one outermost splitter plate to the other outermost splitter plate of the plurality of stacked splitter plates.

2. The arc chamber according to claim 1, wherein, in a top view of the arc chamber, the at least one inhibitor barrier is arranged in a corner part on the entry side of the arc chamber.

3. The arc chamber according to claim 1, wherein the arc chamber comprises at least two inhibitor barriers, each arranged, in a top view of the arc chamber, in opposite corner parts on the entry side of the arc chamber.

4. The arc chamber according to claim 3, wherein, in the top view of the arc chamber, the at least two inhibitor barriers are spaced apart from one another, such that a gap for the entry of the electric arc is formed on the entry side.

5. The arc chamber according to claim 3, wherein the at least two inhibitor barriers each extend in a stacking direction of the splitter plates.

6. The arc chamber according to claim 5, wherein the at least two inhibitor barriers each extend in the stacking direction of the splitter plates from one outermost splitter plate to the other outermost splitter plate of the plurality of stacked splitter plates.

7. The arc chamber according to claim 1, wherein, in a top view of the arc chamber, at least two inhibitor barriers are spaced apart from one another, such that a gap for the entry of the electric arc is formed on the entry side.

8. The arc chamber according to claim 1, wherein, the at least two inhibitor barriers comprise at least one deflection section which extends to an inside of the arc chamber, in a case wherein the at least one deflection selection is defined by one deflection section, the deflection section is designed for trapping and deflecting the electric arc or an arc segment such that it does not propagate back to a region of the gap, and wherein, in a case wherein the at least one deflection selection is defined by more than one deflection section, the deflection sections are designed for trapping and deflecting the electric arc or the arc segment such that it does not propagate back to the region of the gap, the gap being formed on the entry side in between the inhibitor barriers for the entry of the electric arc.

9. The arc chamber according to claim 1, wherein a respective inhibitor plate is provided between each pair of adjacent splitter plates of the plurality of splitter plates.

10. The arc chamber according to claim 1, further comprising:

an inlet of an exhaust channel in a region of the at least one inhibitor barrier, wherein the exhaust channel extends to a gas outlet formed on a side of the arc chamber different from the entry side.

11. The DC circuit breaker comprising the arc chamber according to claim 1.

12. The arc chamber according to claim 1, wherein at least one of the inhibitor plates abuts against adjacent splitter plates to shield the space between the adjacent splitter plates.

13. The arc chamber according to claim 1, wherein the inhibitor plates abut against adjacent splitter plates to shield the space between the adjacent splitter plates.

* * * * *